United States Patent [19]

Hein, III et al.

[11] 4,200,200

[45] Apr. 29, 1980

[54] SHEET DISPENSING CARTON

[75] Inventors: Carl C. Hein, III; Joseph J. Spitz, both of Neenah, Wis.

[73] Assignee: American Can Company, Greenwich, Conn.

[21] Appl. No.: 860,888

[22] Filed: Dec. 15, 1977

Related U.S. Application Data

[63] Continuation of Ser. No. 700,551, Jun. 28, 1976, abandoned.

[51] Int. Cl.[2] ..... A47K 10/42

[52] U.S. Cl. ..... 221/48; 221/63

[58] Field of Search ..... 221/47–63; 229/51 D

[56] References Cited

U.S. PATENT DOCUMENTS

| | | | |
|---|---|---|---|
| 2,322,594 | 6/1943 | Russell | 221/48 X |
| 3,239,097 | 3/1966 | Bates et al. | 221/48 |
| 3,369,699 | 2/1968 | Enloe et al. | 221/48 |

OTHER PUBLICATIONS

Simonds et al, Handbook of Plastics, D. Van Nostrand Co. Inc., 1949, pp. 570–573.

*Primary Examiner*—F. J. Bartuska

*Attorney, Agent, or Firm*—Robert P. Auber; Ira S. Dorman; Ernestine C. Bartlett

[57] ABSTRACT

A sheet dispensing carton having a uniaxially oriented film material covering the dispensing opening thereof. Application of finger pressure to the film produces a straight line slit in the film along the axis of orientation, thus providing abutting lips of film which control the dispensing of an interfolded sheet material product from the carton.

7 Claims, 6 Drawing Figures

SHEET DISPENSING CARTON

This is a continuation, of application Ser. No. 700,551, filed June 28, 1976, now abandoned.

BACKGROUND OF THE INVENTION

This invention relates to improvements in cartons for dispensing disposable sheet materials such as facial tissues or paper towels either in moist or dry condition. More particularly, the invention relates to improvements in the opening through which interfolded facial tissues or the like are sequentially dispensed from a carton in which they are packaged.

This invention provides an improved sheet dispensing carton in which the dispensing opening thereof is initially covered with an impervious film having barrier properties and which is easily severable along a particular axis to form a slit therein through which the sheeted product may be dispensed. The invention comprises an improvement over dispensing cartons such as those described in U.S. Pat. No. 3,239,097, which issued to J. D. Bates et al on Mar. 8, 1966. The Bates et al patent shows, in one embodiment, a carton for interfolded tissues wherein a film with a line of perforations therein covers the customary oval-shaped dispensing opening in the carton. The line of perforations in the film extends longitudinally of the medial axis of the opening between opposite ends thereof and severance of this perforate line of weakness forms a slit in the film through which the interfolded tissues may be sequentially dispensed, the opposed lips of the slit serving to restrain the issuing tissues and restrict them to one-at-a-time dispensing.

Although cartons made in accordance with the Bates et al disclosure display improved dispensing action over cartons of the prior art, the line of perforations required in the film seriously impairs its value as a barrier to ingress of dust and other contaminants and egress of fragrant scents or other volatile components of the packaged contents.

The construction of the present invention provides a uniaxially oriented film over the dispenser opening which is unimpaired in its barrier properties but which is easily ruptured to form a slit running in the direction of orientation of the film, which slit then serves as a restrictive dispensing opening in the same manner as that disclosed in Pat. No. 3,239,097, previously mentioned.

SUMMARY OF THE INVENTION

Briefly, the invention comprises an improved carton for the sequential dispensing of individual sheets from a stack of interfolded sheet material packaged within the carton. A dispensing opening in the carton is covered by a uniaxially oriented, imperforate, barrier-type film which, under applied finger pressure, splits along its axis of orientation to provide a straight-line slit through which the sheets may be dispensed and which provides tension control to insure individual dispensing of the sheets from the carton.

BRIEF DESCRIPTION OF THE DRAWINGS

The invention may be better understood by reference to the following detailed description taken in conjunction with the accompanying drawings, wherein.

DESCRIPTION OF A PREFERRED EMBODIMENT

Figure 1:
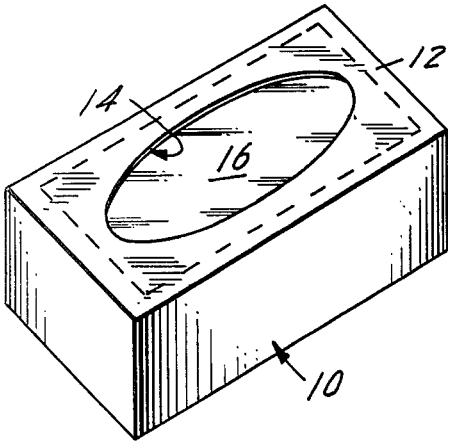
FIG. 1 is a perspective view of a carton incorporating the inventive dispensing feature.

The drawings illustrate a dispenser carton 10, suitably of paperboard or equivalent material, containing a stack of interfolded sheets of facial tissues or similar sheet material product. If desired, the carton may incorporate a gas and moisture barrier, either as a coating on the paperboard or as a liner layer laminated thereto by known methods. The top wall 12 of the carton is provided with a dispensing opening 14 shown as having an elongated elliptical shape, although the contour of the opening may be extensively modified without deleteriously affecting its functionality. In the following description, the term "top wall" refers to that wall of the carton through which the sheet material product is normally dispensed and may vary according to the orientation of the product within the package.

The opening 14 in the top wall 12 is covered by a lightweight film material 16 of a character to be described in detail hereinafter. The film 16 is attached to the underside of the top wall around the periphery of the opening by suitable adhesive 18 and constitutes an imperforate barrier to the passage of particulate or gaseous material into or out of the carton. It is essential in obtaining the objective of this invention that the film 16 shall possess a high degree of uniaxial orientation and it is preferred that the film be so positioned on the carton top wall that the axis of orientation of the film extends substantially parallel to the major axis of the dispensing opening 14 in the carton top wall.

Figure 3:
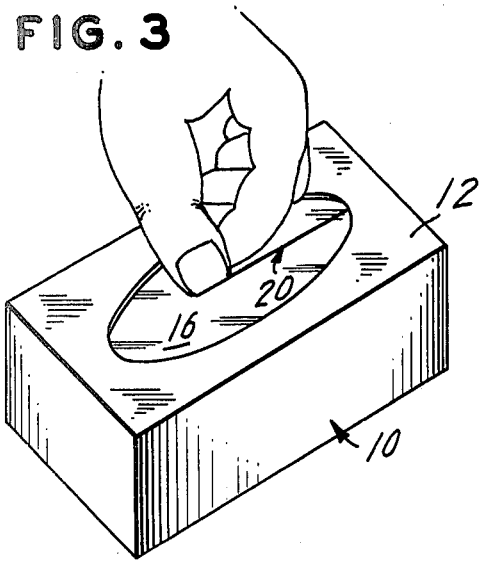
FIG. 3 is a perspective view of a carton during the opening operation.
Figure 4:
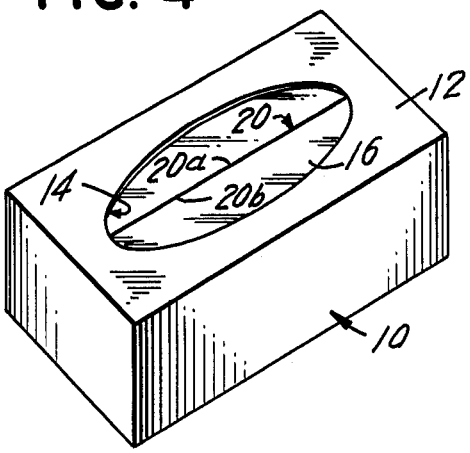
FIG. 4 is a perspective view of the carton after the barrier film is slit to provide an opening.
Figure 6:
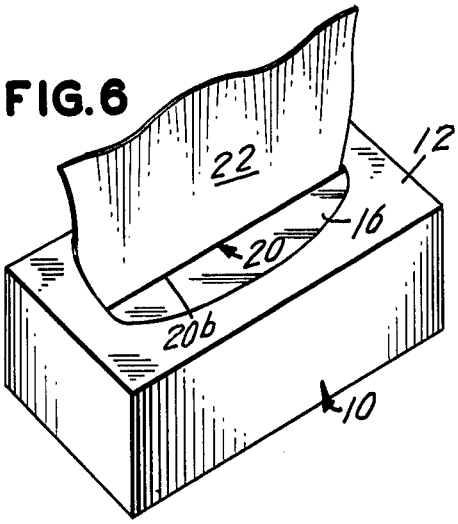
FIG. 6 is a perspective view of a box of tissues, partially broken away, with a tissue being dispensed therefrom.

It has been found that, when a thin, uniaxially oriented film is so positioned, a finger or fingernail pressure applied as shown in FIG. 3 downwardly on the outer surface of the film 16 at any point reasonably close to the greater axis of the elliptical dispensing opening will result in a splitting of the film in the direction of its axis of orientation, thereby forming a slit 20 in the film through which the tissue sheets 22 within the carton may be sequentially dispensed. The opposed lips or edges **20*a* and 20*b* of the slit 20** so formed remain substantially in abutment throughout the length of the slit as shown in FIG. 4 but may be readily separated by thumb and forefinger for grasping an edge of the uppermost sheet in the stack of interfolded tissues packaged in the carton. The stacked tissues may be interfolded in Z-configuration or in other conventional manner so that withdrawal of the trailing portion of an advance tissue will bring the leading edge portion of the succeeding tissue up through the abutting lips of the slit in the window film where it will remain frictionally engaged as illustrated in FIG. 6, to be subsequently withdrawn as required.

The film may be transparent or opaque, although transparency is preferred as it allows the consumer to see the packaged product to identify and select a package containing a desired color or design of the packaged goods. If desired, a line of ink may be printed on the film along the major axis of the opening and printed indicia may direct the consumer to apply downward pressure along the printed line to form the dispensing slit.

Figure 2:
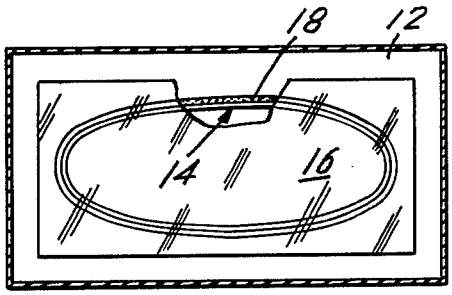
FIG. 2 is a plan view of the under surface of the top wall of the carton of FIG. 1, with the inner film layer partially cut away.

As may be seen in FIG. 2, the film 16 is attached by a suitable adhesive 18 to the inner surface of the top carton wall so as to completely cover the dispensing opening 14 therein. In the manufacture of the construction, the adhesive is pattern-applied either to the paperboard carton blank or to the film web, after which the two elements are brought together in register and maintained under moderate pressure until the adhesive has hardened. During this operation, the film web is maintained under a moderate degree of tension to insure that it will cover the carton opening tautly without sagging or wrinkling. Tautness of the film is desirable when the film 16 is subjected to pressure for formation of the dispensing slit 20 hereinbefore described.

To be satisfactory for use in the present invention, the film 16 must be capable of a high degree of orientation along a given axis. Such orientation is generally achieved in known manner by compression rolling of the film or by stretching the film linearly between nips or surfaces operating at different speeds. Polyethylene having a specific gravity of greater than about 0.94, usually referred to as high density polyethylene, is of particular utility both for its excellent performance characteristics and also from the economy standpoint. Uniaxially oriented high density polyethylene (HDPE) of between 0.75 mil and 1.5 mil thickness is the preferred material for use in this invention. Of nearly comparable utility are films of homopolymeric polypropylene polyacrylonitrile, polystyrene and a terpolymer of acrylonitrile, butadiene and styrene. Copolymers of propylene with ethylene, medium density polyethylene, polyvinyl chloride, polyethylene terephthalate and polyamides of the nylon type are also of some utility in this invention, although they are somewhat less satisfactory than high density polyethylene. Films such as low density polyethylene, ethylene vinyl acetate copolymers, ethylene ethyl acrylate compolymers, polybutylene and ionomers of polyethylene have not shown utility in this invention. Depending on the composition of the film selected and the degree of orientation thereof, the optimum film thickness will vary from about 0.25 mil to about 2.0 mil, the generally preferred range being from about 0.75 mil to 1.5 mil in thickness.

In general the inherent strength of polymeric materials arises from several molecular forces. The overwhelming contribution comes from the covalent bonds along the chain axis of the molecules. Orientation along a single axis results in the predominant alignment of the chain axis of the molecules parallel to the orientation direction, thereby giving great strength in that direction.

Furthermore, the resultant lack of molecules aligned in the direction perpendicular to the direction of orientation results in weak bonds in the transverse direction. The uniaxial orientation of the molecules thus accounts for the very great differences in tear strength between the with-grain axis and the cross-grain axis of the film. It is this difference which gives rise to the linear splitting essential to use of a given film in the present invention. High density polyethylene and other polymers which exhibit relatively high crystallinity have low amounts of amorphous or branched molecules to form cross-grain ties or entanglements. In the monoaxially oriented state these films will split linearly under application of a slight amount of pressure, the resulting slit running in the direction of orientation of the film.

The most desirable uniaxially oriented films for use in this invention will tear very easily to form a slit running in the with-grain direction, or parallel to the axis of orientation, whereas it is very difficult to tear the film across the grain, or perpendicular to the axis of orientation.

In order for a film to perform satisfactorily in this invention, it is, of course, necessary that the tensile strength, measured in the machine, or with-grain direction, be significantly greater than in the transverse or cross-grain direction. Generally, the with-grain to cross-grain tensile strength ratio should be greater than 1.5 to 1, and preferably greater than about 4 to 1. The possession of a tensile strength ratio within the desired range is, however, not sufficient to guarantee the satisfactory performance of a film in the invention since it is also necessary that the film be capable of no more than very moderate elongation in either the machine or the transverse direction. That is, the degree by which the film may be stretched in either direction prior to reaching its breaking point must be no more than about 150% of its original length (in other words, no portion of the film may be extended to more than 2.5 times its original length or width before it will break). Preferably, the film will exhibit no more than a 100% extensibility, especially in the transverse direction.

Thus, for example, the preferred high density polyethylene film exhibits a with-grain to cross-grain tensile strength ratio of between 5 to 1 and 6.5 to 1, a transverse elongation of between 20 and 50% and a machine direction elongation of between 30 and 75%. Therefore, as finger or fingernail pressure is applied to the film to start the formation of a dispensing slit, the film will tend to break rather than to stretch, since the film is relatively inextensible. Furthermore, since the tensile strength ratio strongly favors film severance in response to forces applied in the transverse or cross-grain direction rather than in response to forces applied in the direction of orientation, or machine direction, the slit forms and is propagated with the grain, rather than across it.

Other uniaxially oriented films which are very satisfactory for use in this invention also exhibit comparable elongation and tensile ratio characteristics. In the following Table 1 are tabulated the maximum elongation values and the with-grain to cross-grain tensile strength ratios of a number of uniaxially oriented films. In each case, the films have been oriented by compression rolling in accordance with the process set forth in U.S. Pat. No. 3,504,075, the degree of orientation being substantially the maximum obtainable by the compression rolling process in each case. The films in Table 1 have been grouped in three categories, ranging from the most satisfactory for use in the present invention to those which have proven to be unacceptable by virtue of an unsatisfactory combination of the properties previously mentioned.

TABLE

| Film | Tensile Strength Ratio* | Maximum Elongation With-Grain | Maximum Elongation Cross-Grain |
|---|---|---|---|
| Most Desirable Films | | | |
| High Density Polyethylene | 5:1 to 6.5:1 | 30–75% | 20–50% |

TABLE -continued

| Film | Tensile Strength Ratio* | Maximum Elongation With-Grain | Maximum Elongation Cross-Grain |
|---|---|---|---|
| Polypropylene (Homopolymer) | 5:1 to 6:1 | 100–150% | 25–150% |
| Polyacrylonitrile | 2.2:1 | 60% | 100% |
| Acrylonitrile-Butadiene-Styrene Terpolymer | 1.5:1 | 60% | 35% |
| Polyvinyl Chloride | 1.5:1 to 2.5:1 | 50–60% | 7–15% |
| Satisfactory Films | | | |
| Propylene-Ethylene Copolymer | 5:1 to 6:1 | 50–100% | 100–250% |
| Polyamide (Nylon) | 2:1 to 3:1 | 150% | 150–200% |
| Polyethylene Terephthalate | 4:1 | 100% | 50–300% |
| Unacceptable Films | | | |
| Low Density Polyethylene | 7.5:1 to 15:1 | 30–150% | 200–500% |
| Polyethylene Ionomer | 5:1 to 6:1 | 50–80% | 200–500% |
| Ethylene-Vinyl Acetate Copolymer | 8:1 | 20–50% | 400–500% |

*With-Grain to Cross-Grain

As may be seen from the data in Table 1, the most desirable films, such as high density polyethylene, exhibit, as a necessary combination of physical characteristics, a relatively high tensile strength ratio and a maximum elongation in each direction of less than 150%. The preferred high density polyethylene sheet, after subjection to the highest degree of uniaxial orientation reasonably attainable, has a tensile strength ratio (with-grain to cross-grain) of greater than 4 to 1 and generally between 5 to 1 and 6.5 to 1, a maximum with-grain elongation of from 20 to 100% and preferably from 30 to 75%, and a maximum cross-grain elongation of from 20 to 100% and preferably between 20 and 50%. Other desirable and satisfactory films show tensile and elongation values within the limits previously stated as acceptable.

It will be further noted from the data in Table 1, that the films which are unacceptable for use in this invention show a maximum cross-grain extensibility substantially greater than 150%, which was previously stated as being the maximum satisfactory level. Films such as low density polyethylene (density below about 0.93), even when subjected to the highest reasonably attainable degree of uniaxial orientation, are too "stretchy" or extensible in a transverse direction to split readily along the axis of orientation upon the application of finger pressure to the taut film. The high level (200–500%) of maximum extensibility in a transverse direction thus precludes this and similar films from use in this invention, even though the tensile strength ratio is very favorable and well within the desired range.

Figure 5:
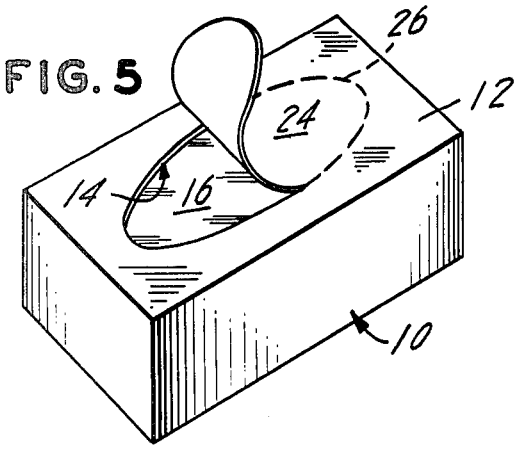
FIG. 5 is a perspective view of another embodiment of the carton of this invention during a preliminary opening step.

In FIG. 5 is illustrated an alternative form of carton incorporating the present invention, wherein the top wall 12 of the carton is provided with a removable panel 24 delineated by an elliptical line of perforations 26 passing through the paperboard but not through the underlying uniaxially oriented plastic film 16. This paperboard panel serves as added mechanical protection for the underlying film and for the product within the package. The protective panel 24 may be removed in conventional manner by breaking the line of perforations 26 to sever the panel from the top wall, 12 after which the panel may be lifted out and discarded. A dispensing slit may then be formed in the underlying film 16 by simple downward pressure on the film at any point on the longitudinal axis of the elliptical window, the slit being propagated linearly along the axis of orientation of the film. Since the film is normally and preferably adhered to the carton top wall with its axis of orientation coincidental with the major or longitudinal axis of the window aperture, the slit will then extend along such axis.

It is, or course, to be understood that the window aperture may vary from the elliptical shape shown and that the axis of orientation of the film may be aligned as desired in relation to the geometry of the aperture in order to achieve the desired dispensing action when the dispensing slit has been formed in the film.

It is further to be understood that the invention is subject to various other modifications which are considered to be within the spirit thereof. For example, if desired, the uniaxially oriented film material may be adhered to the outer, rather than to the inner surface of the carton top wall in such a way as to cover the dispensing opening, or may be applied as a band completely encircling the carton, the axis of orientation of the film band being parallel to the major axis of the dispensing opening in the carton top wall.

We claim:

1. A tissue-dispensing carton including wall portions, at least one of said wall portions including a tissue-dispensing opening covered by a continuous, single layer of an imperforate, uniaxially oriented, barrier type thermoplastic, polymeric film tensioned across said opening and adhered to said wall portion;

said film being uniaxially oriented to the extent that it exhibits tensile strength in the orientation direction that is substantially greater than the tensile strength in the direction perpendicular to the orientation direction, whereby said film splits along a line extending in the orientation direction to form a single, straight-line slit responsive to finger or fingernail pressure applied downwardly on its surface; said slit being defined by substantially abutting edges of said film between which edges said tissues may be dispensed and frictionally restrained; said film has a with-grain to cross-grain tensile strength ratio greater than 1.5 to 1 and a maximum elongation in both with-grain and cross-grain directions of no more than 150%, such that said single, straight line slit can be formed solely by said finger or fingernail pressure.

2. A carton according to claim 1 wherein said film is adhered to the inner surface of said one wall portion adjacent to said opening.

3. A carton according to claim 2 wherein said dispensing opening possesses a major axis and a minor axis, and wherein the axis of orientation of said film is parallel to the major axis of said dispensing opening.

4. A carton according to claim 3 wherein said film is selected from the group consisting of high density polyethylene, homopolymeric polypropylene, polyacrylonitrile, acrylonitrilebutadiene-styrene copolymer, and polyvinyl chloride.

5. A carton according to claim 4 wherein said film is high density polyethylene of between 0.75 and 2.0 mil in thickness.

6. A carton adapted for the sequential dispensing of successive sheets of interfolded flexible sheet materials, said carton having at least one wall portion that includes an opening covered by a continuous layer of an imperforate, uniaxially oriented, high density polyethylene film tensioned across said opening and adhered to said wall portion;

said polyethylene film being uniaxially oriented to the extent that it exhibits a tensile strength in the orientation direction that is substantially greater than the tensile strength in the direction perpendicular to the orientation direction, whereby said polyethylene film splits along a line extending in the orientation direction to form a single, straight-line slit when pressed with finger or fingernail pressure; said film has a with-grain to cross-grain tensile strength ratio greater than 1.5 to 1 and a maximum elongation in both with-grain and cross-grain directions of no more than 150%, such that said single, straight line slit can be formed solely by said finger or fingernail pressure.

7. A carton according to claim 6 wherein said film is high density polyethylene of a thickness between 0.75 and 2.0 mil and having a ratio of with-grain to cross-grain tensile strength of greater than 4 to 1 and a maximum elongation in both the with-grain and cross-grain directions of between 20 and 100%.

* * * * *